United States Patent [19]

Seipenbusch

[11] Patent Number: 4,563,196

[45] Date of Patent: Jan. 7, 1986

[54] COAL CHARGING IN A COAL GASIFICATION INSTALLATION

[75] Inventor: Jürgen Seipenbusch, Essen, Fed. Rep. of Germany

[73] Assignee: Ruhrkohle Aktiengesellschaft, Essen, Fed. Rep. of Germany

[21] Appl. No.: 591,201

[22] Filed: Mar. 19, 1984

Related U.S. Application Data

[63] Continuation of Ser. No. 165,495, Jul. 3, 1980, abandoned.

[51] Int. Cl.[4] ..... C10J 3/46

[52] U.S. Cl. ..... 48/210; 48/202; 48/DIG. 7; 252/373; 406/197

[58] Field of Search ..... 48/202, DIG. 7, 210; 44/51, 52; 406/46, 49, 197; 423/438; 252/373

[56] References Cited

U.S. PATENT DOCUMENTS

| | | | |
|---|---|---|---|
| 1,790,303 | 1/1931 | Gosselin | 423/438 |
| 3,389,714 | 6/1968 | Hughes et al. | 406/46 |
| 3,957,460 | 5/1976 | Lee | 48/DIG. 7 |
| 4,101,295 | 7/1978 | Sadler | 48/DIG. 7 |
| 4,166,802 | 9/1979 | Slater | 48/DIG. 7 |
| 4,211,590 | 7/1980 | Netzr | 48/DIG. 7 |

FOREIGN PATENT DOCUMENTS

| | | | |
|---|---|---|---|
| 1143844 | 2/1969 | United Kingdom | 423/438 |

*Primary Examiner*—Peter Kratz
*Attorney, Agent, or Firm*—Nils H. Ljungman

[57] ABSTRACT

In a coal-gasification reactor installation, carbon dioxide gas is added into a liquid coal suspension in the form of fine bubbles of gas to improve the flowability and dispersion of the liquid coal suspension. In a preferred embodiment, carbon dioxide is separated from the gaseous reactor products, dissolved in an ammonium solution, reacted to form solid ammonium carbonate salt; the solid chemical salt is added to the liquid coal suspension where it is made to decompose and generate carbon dioxide gas.

8 Claims, 2 Drawing Figures

COAL CHARGING IN A COAL GASIFICATION INSTALLATION

BACKGROUND OF THE INVENTION

This is a continuation of the U.S. application Ser. No. 06/165,495 filed on July 3, 1980 now abandoned.

The reactor of a coal-gasification installation generally is operated under a pressure in excess of the ambient. In order to allow the buildup of such pressure and to maintain it, a lock is used for charging and discharging the reactor. In this regard it may be necessary when a lock is used that the carrier of the coal be mostly liquid, in order that material charging and discharging can be made with pumps and spirals, for instance. This means that the pumps, or other contrivances must operate on a mixture that can be pumped; e.g., on matter having a relatively large degree of flowability.

Water is preferably called for as the fluid carrier since it can at the same time serve as reactive material in the process of manufacturing gas containing CO and $H_2$. The chemical reaction results from bringing the pumpable suspension of solid, which is in the form of coal and water, into contact with oxygen inside a suitable reaction chamber.

The use of water, however, presents the disadvantage that there may be an unfavorable energy balance, since any excess of water has to be vaporized.

Accordingly, the invention provides a solution to the problem of improving the economics of coal gasification. The invention stems from the concept that the economics of the chemical process will be improved by a change in the way of charging coal.

SUMMARY OF THE INVENTION

According to the present invention an inert gas, preferably carbon dioxide is mixed with a liquid suspension of coal, the gas being finely divided throughout the liquid coal suspension. This has first of all a very advantageous effect on the behavior of the feed by reducing its viscosity. Another advantage is a positive effect on the dispersion of the suspension at the exit from the burner into the reactor. There are several approaches in carrying out the invention. One may elect to blow gas through nozzles into the path of a liquid suspension of coal and/or have the coal suspension mixed with a liquid carrying gas. It is also possible to mix the fluid with solids evolving gas. If the gas carrier is a solid, it disintegrates in the coal suspension, or reacts with it, so that gas is liberated.

The gas which according to the present invention is to be mixed with the liquid suspension of coal to be charged into the reactor preferably consists of carbon dioxide evolving, or recovered from the raw gas itself which is generated by the reactor. According to the preferred embodiment of the invention, carbon dioxide generated by the reactor is dissolved into an ammonium solution, or is converted into ammonium carbonate. In the latter instance a water solution of ammonium becomes saturated with salt. Thus, a solution containing dissolved or reacted carbon dioxide gas can be fed with the solid combustible into a wet grinder or it can be mixed with dry-ground solid combustible.

DESCRIPTION OF THE PREFERRED EMBODIMENT OF THE INVENTION

Figure 1:
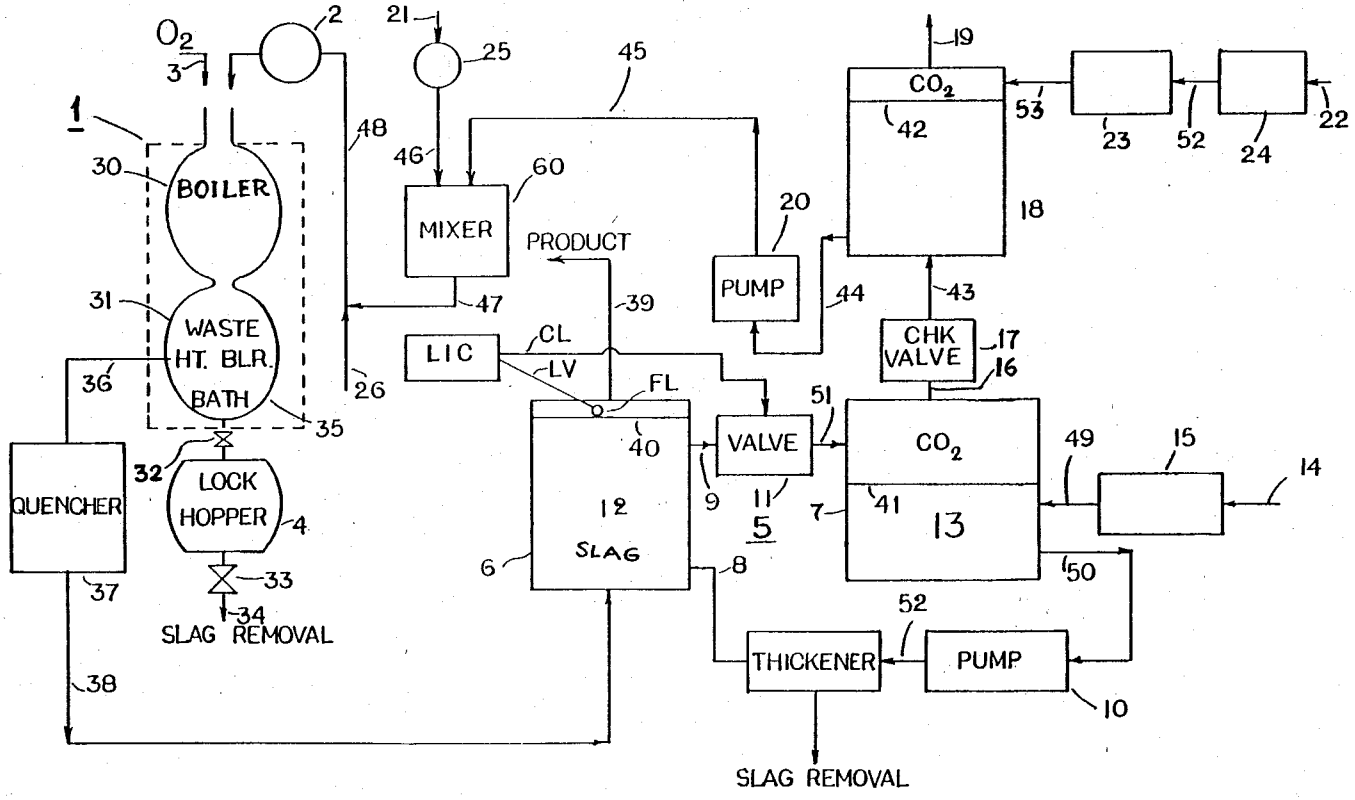
FIG. 1 shows in block diagram a coal gasification installation in which, under the preferred embodiment of the invention, carbon dioxide derived from the gas products is chemically reacted and injected before evolving in the form of bubbles of gas in the coal suspension charging the main reactor.

Referring to FIG. 1, a liquid suspension of coal is fed from the top, with the assist of a pump 2, into the reactor 30 of a coal-gasification installation. Oxygen also is injected into the reactor through an inlet 3. Typically, in the reactor 1, reaction takes place at a temperature of about 1400° C. and under a pressure of 30 bar.

The liquid-phase of the coal suspension consists, according to the preferred embodiment, of water. However, it may have another composition. For instance, it may be oil, an oil residue, or the like. The water of the coal suspension is vaporized under the effect of the heat in the reactor. The coal reacts with the oxygen and the generated steam. The reaction yields synthesis-gas having a high percentage of carbon monoxide and free hydrogen. This synthesis-gas is an important chemical raw material.

FIG. 1 shows the reactor 30 and a waste heat boiler 31, one above the other. At the bottom of the waste heat boiler is a water bath 35 used to collect slag evolving from the reaction. The water bath also holds back the synthesis-gas and serves as a seal for the gas under pressure inside the reactor. The gas product leaves the reactor by a conduit 36, passes in a quencher 37 and is taken away through another conduit 38. The slag collecting in the water bath is discharged into the atmosphere with the assist of a lock and a valve 33 at the exhaust thereof. Emptying the lock is accomplished when a valve 33 is open and this occurs under the pressure inside the reactor, typically 30 bar.

The lock 4 consists of a container having a valve 32 at the entrance and a valve 33 at the exit. Slag which has sunk through the water bath to the bottom of reactor 1 collects in the hopper of lock 4 when the entrance valve 32 is open. Once the container is filled up to a certain level, valve 32 at the entrance is closed and valve 33 at the exhaust is opened. As a result, slag can be removed from the lock hopper 4 without interfering with the continuous operation of the reactor. Thereafter, valve 33 at the discharging end is closed again. The lock hopper 4 is filled with water via valve 32 which, at the charging end, has been opened again.

Another portion of the slag falling in reactor 1, the volatile slag portion, goes with the exhaust of the waste heat boiler 31; e.g., by conduit 36 together with the synthesis-gas. The synthesis-gas has, by then, already experienced cooling through the waste heat recovery boiler 31. Following the exhaust from waste heat boiler 31 further cooling occurs, in a quench cooler 37.

From conduit 36 the raw gas enters a carbon-dioxide absorber system 5. The carbon-dioxide absorber system 5 consists of two pressure vessels 6 and 7 containing water and connected to one another through pipes 8 and 9. Vessel 6 contains a bath 12 connected, towards its upper region, by pipe 9 and a throttle valve 11 to the space above the surface of a bath 13 inside vessel 7. Liquid is fed back from the lower part of bath 13 into bath 12 via line 50, pump 10, pipe 52, and pipe 8. Bath 13 is under a pressure which is equal to or a little less than the pressure in the chamber of reactor 1.

The gas product in conduit 38 is admitted at the bottom of bath 12 into vessel 6. Under the existing pressure, carbon dioxide gas contained in the gas product dissolves in substantial amount into bath 12, while the gas product emerging at the surface 40 of the bath is being carried away by an exhaust pipe 39. As a result of a large pressure drop existing between vessels 6 and 7, the liquid enriched with carbon dioxide flows from vessel 6 into vessel 7 via pipes 9 and 51 except for the regulating action of throttle valve 11. Thus, throttle valve 11 maintains a differential pressure between the two vessels. Moreover, the pressure is reduced when the water reaches vessel 7 to a degree determined by the pressure existing in vessel 7. As a result of such reduced pressure, carbon dioxide is released from the water and it escapes from the surface 44 of bath 13 leaving via conduit 16, check valve 17 and conduit 43.

In order to prevent the raw gas flowing through the water bath 12 of vessel 6 and leaving by pipe 39 above the level 40 of the bath 12 from entering pipe 9, the water level 40 of bath 12 is maintained above the level of the inlet of pipe 9 leading from pressure vessel 6 to vessel 7. This is achieved by regulating the throttle valve 11 and/or the pump 10. Automatic adjustment of the throttle valve 11 opening (and/or the effect of pump 10) is obtained in response to a float FL resting on the surface 40 inside vessel 6, as illustratively shown. The throttle valve 11 is controlled by line CL which may be a rod and/or a hydraulic arrangement, acting upon the throttle valve 11. When float FL is displaced, a connector LV causes a controller LIC to actuate via CL the throttle valve 11. A smaller or different arrangement can also be used to control the pump 10, separately or concurrently. Any loss of water will be compensated by a supply duct 14 via a valve 15 actuated automatically, or remotely by hand.

Slag evolving from the raw gas collects with the carbon dioxide in bath 12. The slag is separated, owing to a thickener interposed in the path of pipe 8 after the pump 10. The slag is then removed.

Instead of water, the carbon-dioxide absorber system 5 can also operate with alcohol or amine solutions. If alcohol is used, an operative temperature of less than 50° C. is required.

Instead of carbon-dioxide absorber system such as illustrated in FIG. 1, it is possible to use a separator system. By separator system is meant a system in which only the carbon dioxide is separated from raw gas, while with ordinary carbon dioxide absorbers in general, other undesired constituents are absorbed. In the separation, for instance, a precipitate of carbon dioxide is formed with a base in the vessel 6. When reacting with the base, carbon dioxide forms a salt which is extracted from the vessel 6, then treated with water and heated so that the carbon dioxide is liberated and the liberated gas can be derived as shown from pipe 16 of FIG. 1.

The carbon dioxide collected above the surface 41 of bath 13 in vessel 7 is admitted through pipe 16 and check valve 17 into a vessel 18. Vessel 18 contains a concentrated ammonium water solution. By bubbling through the ammonium solution of vessel 18, a substantial portion of the carbon dioxide dissolves into the ammonium solution and is converted into ammonium carbonate. The remaining carbon dioxide freely evolves above the surface 42 and is evacuated through pipe 19. The ammonium solution when carbon dioxide is dissolved becomes loaded with salt which is extracted by a pump 20 through a pipe outlet located at the lower part of vessel 18. The pumped-out salt solution is mixed in a mixer 60 with the coal admitted by line 46 after it has been ground by grinder 25. From the mixer by lines 47 and 48 the coal suspension containing the added salt solution is fed into the reactor with the assist of a pump 2.

The ammonium solution concentrated with salt can also be added to the coal into the charging inlet 21 thus, before it is ground in the grinder 25 when grinding is done in a wet state. The ammonium solution can also be added after grinder 25, as shown in FIG. 1, where the salt solution is added in a mixer 60 together with the ground coal from the grinder outlet 46, while the coal has been ground in a dry state.

In the feedline of reactor 1 the carbon dioxide is liberated again by heating the liquid suspension of coal. The ammonium carbonate disintegrates also as a result of the addition of small quantities of an acid; for example, phosphoric acid, which is fed by line 26 into conduit 47 coming from the mixer 60. The necessary dosage is achieved from the inlet 26, with a pump (not shown). The pump may be continuously feeding the acid into a special regulatory valve, or an injection pump operating intermittently can be used instead.

The carbon dioxide liberated in the feedline 48 appears in the liquid suspension as many small bubbles. These bubbles improve substantially the flowability of the liquid-coal suspension.

Such small bubbles, because they have a lower rising velocity than would larger ones, give a remarkable stability to the threefold mixture obtained by the addition of gas.

Instead of mixing, with the coal suspension, a liquid or a solid gas-carrier, gas may be injected directly into the feedline 48 of the reactor with the assist of special nozzles disposed at locations situated between grinder 25 and pump 2, or between pump 2 and reactor 1. To this end, provision is made for many small nozzles located at the lower side of the feedline 48. The gas used is preferably gas obtained from carbon dioxide which has been regenerated, or separated from the gas product.

Preferably, nozzles are disposed at the lower side of the feedline so that they occupy at least a third of the periphery thereof while being evenly distributed. It has been found that such arrangement provides an optimum injection of gas into the liquid suspension of coal.

Figure 2:
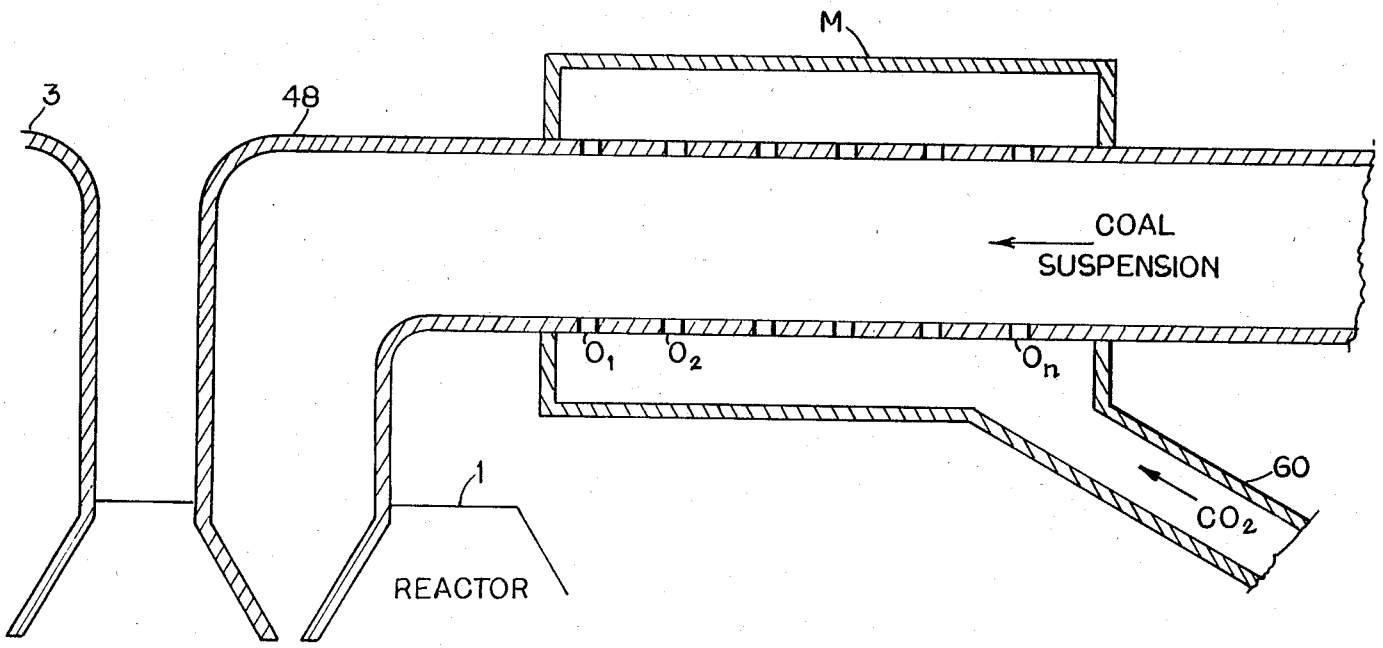
FIG. 2 illustrates one mode of injecting gas directly into the feedline of coal suspension.

In the simplest form, as shown in FIG. 2, the nozzles can merely consist of apertures $0_1 \ldots 0_n$ provided at the lower side of the feedline 48 while a conduit 60 leading to these nozzles is provided which terminates as a mantle M surrounding the feedline 48.

What is claimed is:

1. In a coal gasification process using a reactor producing a product gas which contains carbon dioxide, a method of charging a liquid suspension of coal into said reactor so as to increase the fluidity of said liquid coal suspension, said method comprising the steps of:

(a) separating carbon dioxide gas from reactor product gas for selective feedback into said reactor, said fed-back carbon dioxide gas not actively participating in and not thermally affecting the reaction in said reactor;

(b) absorbing said separated carbon dioxide, of step (a), to form a reacted solid chemical compound form for feeding back into said liquid coal suspension in controlled quantities; and (c) admitting a predetermined quantity of said chemical compound into said liquid suspension to liberate carbon dioxide gas in a bubble form into said liquid suspension which enters said reactor, said liberated carbon dioxide gas causing increased fluidity of said liquid suspension and facilitating dispersion of said liquid coal suspension at its entry into said reactor.

2. The method as in claim 1, wherein said step of separating carbon dioxide gas comprises using a gas extractor to result in said solid chemical compound which is used as a gas-carrier for feedback into said liquid suspension, the method including the step of liberating the carbon dioxide from said solid chemical compound by an acid.

3. The method of claim 1, wherein the step of absorbing said separated carbon dioxide includes the step of dissolving the generated carbon dioxide in ammonium water to form an ammonium solution containing solid ammonium carbonate.

4. The method of claim 3, including the step wherein a solid combustible comprising said coal is fed for grinding in a wet form with ammonium solution charged with said solid chemical containing dissolved carbon dioxide.

5. The method of claim 3, including the step wherein where the ammonium solution is mixed with dry, ground, solid combustible comprising said coal.

6. The method of claim 3, including the method step of mixing acid with a mixture of the liquid suspension of coal and ammonium carbonate to liberate carbon dioxide bubbles.

7. The method of claim 2, wherein the acid is mixed after mixing of the ammonium solution with the liquid suspension of coal.

8. The method of claim 2, with said acid comprising phosphoric acid.

* * * * *